US005860542A

United States Patent [19]

Takamatsu

[11] Patent Number: 5,860,542

[45] Date of Patent: Jan. 19, 1999

[54] SEALING DEVICE AND CONTAINER

[75] Inventor: Kouichi Takamatsu, Ichikawa, Japan

[73] Assignee: Shibazaki Seisakusho Ltd., Ichikawa, Japan

[21] Appl. No.: 836,417

[22] PCT Filed: Nov. 14, 1996

[86] PCT No.: PCT/JP96/03334

§ 371 Date: May 14, 1997

§ 102(e) Date: May 14, 1997

[87] PCT Pub. No.: WO97/18139

PCT Pub. Date: May 22, 1997

[30] Foreign Application Priority Data

Nov. 15, 1995 [JP] Japan ..... 7-297161

[51] Int. Cl.[6] ..... B65D 49/02

[52] U.S. Cl. ..... 215/44; 215/252

[58] Field of Search ..... 215/44, 252

[56] References Cited

U.S. PATENT DOCUMENTS

| | | | |
|---|---|---|---|
| 4,666,053 | 5/1987 | Corcoran et al. . | |
| 4,756,438 | 7/1988 | Ryder | 215/252 |
| 5,050,753 | 9/1991 | Trump et al. | 215/252 |
| 5,137,163 | 8/1992 | Moore | 215/252 |
| 5,167,335 | 12/1992 | McBride et al. . | |
| 5,205,426 | 4/1993 | McBride et al. . | |
| 5,533,633 | 7/1996 | King | 215/252 |
| 5,564,582 | 10/1996 | Kamath | 215/252 |
| 5,660,288 | 8/1997 | Nyman, Jr. | 215/44 |
| 5,667,088 | 9/1997 | King et al. | 215/252 |

FOREIGN PATENT DOCUMENTS

| | | |
|---|---|---|
| 0231905 | 8/1987 | European Pat. Off. . |
| 46-24152 | 8/1971 | Japan . |
| 48-24451 | 7/1973 | Japan . |
| 60-161054 | 10/1985 | Japan . |
| 61-99539 | 6/1986 | Japan . |
| 61-217358 | 9/1986 | Japan . |
| 61-164144 | 10/1986 | Japan . |
| 62-11745 | 1/1987 | Japan . |
| 62-159349 | 10/1987 | Japan . |
| 62-251352 | 11/1987 | Japan . |
| 2/296666 | 12/1990 | Japan . |
| 6/24458 | 2/1994 | Japan . |
| 7/291317 | 11/1995 | Japan . |

*Primary Examiner*—Stephen K. Cronin
*Attorney, Agent, or Firm*—Dilworth & Barrese

[57] ABSTRACT

A sealing device comprises a container and a synthetic resin cap attached to the mouth portion thereof. The synthetic resin cap has a cap main body composed of a top plate portion and a tube portion extending downward from the periphery thereof, the tube portion being separated by means of a tearable weakening line into an upper main portion and a lower tamper-evidence ring portion, a threaded portion being formed on the inner wall surface of the main portion, and erectable engaging projections being provided on the inner wall surface of the tamper-evidence ring portion. The container has an external thread formed on the outer circumference of the upper end of the mouth portion thereof, an annular expanded portion formed underneath the external thread, and at least one depressing portion formed on the expanded portion which engages the engaging projections on the cap and pushes down the engaging projections when the synthetic resin cap attached to the container mouth portion is twisted in the cap-opening direction.

20 Claims, 5 Drawing Sheets

SEALING DEVICE AND CONTAINER

BACKGROUND OF THE INVENTION

The present invention relates to sealing devices comprising containers and synthetic resin caps having tamper-evidence capabilities for sealing the mouth portions of these containers.

In recent years, synthetic resin containers composed of polyethylene terephthalate (PET bottles) have come into common use as beverage containers. Synthetic resin containers have the advantageous properties of being light and shatterproof in comparison to conventional glass bottles.

Additionally, as caps for this type of synthetic resin, metallic caps of aluminum alloy or the like have been conventionally used. The use of synthetic resin caps is also being advanced to replace these types of metallic caps.

With regard to these types of synthetic resin caps, those disclosed in Japanese Patent Application, First Publication No. Sho 62-251352 and Japanese Patent Application, First Publication No. Hei 2-296666 are known.

These conventional synthetic resin caps are screwed onto containers having an external thread formed on the mouth portions and annular expanded portions below the external thread; the caps are composed of a synthetic resin cap main body formed by a top plate portion and a tubular portion which extends downward from the peripheral portions thereof, and a thin liner provided on the inner surface of the top plate portion of the cap main body, the cap main body being such that the bottom portion thereof is separated, by means of a horizontal score formed around the circumference while leaving a plurality of thin bridges, into a main portion above and a tamper-evidence ring portion below the horizontal score. A threaded portion for screwing onto the external thread on the container mouth portion is formed on the inner wall surface of the main portion of the cap main body, and multiple wings or tabs are provided so as to be capable of being uplifted on the inner wall surface of the tamper-evidence ring portion.

Additionally, as the containers, those having an external thread formed on the outer circumference of the top end portion of the mouth portion and provided with an annular expanded portion (locking ring) below the external thread are used.

With these types of caps having tamper-evidence capabilities, the relationship between the rotational angle (the seal release angle, hereinafter abbreviated to SRA) at the moment the seal of the container is released due to the top end of the container mouth portion being separated from the inner surface of the cap or the liner when the cap attached to the container mouth portion is rotated from the initial position in the direction of opening, and the rotational angle (the bridge breaking angle, hereinafter abbreviated to BBA) at the position where the bridges are broken when the cap attached to the container mouth portion is rotated from the initial position in the direction of opening is held to preferably be such that SRA —BBA=0 degrees or greater, more preferably +30 degrees or greater.

However, with the above-mentioned synthetic resin caps, there are cases wherein the bridges formed from synthetic resin expand and the engaging projections (wings or tabs) are so soft as to bend when engaging with the annular expanded portion, as a result of which the BBA can increase and SRA–BBA can become less than 0 degrees; thus, there are points requiring improvement from the point of view of tamper-evidence capabilities.

As sealing devices designed to increase the above-described tamper evidence capabilities using synthetic resin caps, those described in Japanese Patent Application, Second Publication No. Hei 3-56990 are known. These sealing devices comprise engaging claws having engaging side edges extending downward with a tilt in the cap-opening direction underneath the external thread of the container, and engaged claws which cooperate with the above-mentioned container engaging claws formed on the inner walls of the tamper-evidence ring portion of the cap. With the sealing device of Japanese Patent Application, Second Publication No. Hei 3-56990, when the cap is turned in an cap-opening direction with the cap attached to the container mouth portion, the engaged claws formed on the tamper-evidence ring portion are guided to the tilted engaging side edges of the engaging claws so as to be forced downward, and the tamper-evidence ring portion is forced to move downward to accelerate tearing along the tear line formed on the cap tube portion.

However, in these conventional sealing devices, since the engaged claws formed on the cap have a fixed structure such as not to bend, the engaged claws on the cap side must be forced past the engaging claws on the container when the cap is attached to the container, so that the plurality of bridges which couple the main portion of the cap tube portion with the tamper evidence portion must be reinforced to some extent, as a result of which the resistance to breakage of the bridges when the cap is opened is large and the seal cannot be easily opened. Additionally, in order to prevent the bridges from breaking when the cap is attached (sealing), the tamper-evidence ring portion could be given an engaging structure for preventing relative movement in the cap-closing direction, but this presents a problem in that it would become difficult to mold the cap and the costs would increase. Furthermore, since these containers according to the conventional art are for engaging the engaged claws having fixed structures such as not to bend, these containers cannot be applied to caps provided with multiple wings or tabs which are capable of standing on the inner wall surface of the tamper-evidence ring portion as described in Japanese Patent Application, First Publication No. Sho 62-251352 and Japanese Patent Application, First Publication No. Hei 22-96666. That is, with the structure of the container described in Japanese Patent Application, Second Publication No. 3-56990, only engaging claws having engaging side edges extending downward while tilting in the cap-opening direction are formed underneath the external thread, so that when the cap is turned in a cap-opening direction and the wings or tabs contact the tips of the engaging claws, their tips are bent upward, allowing the engaging claws to pass without engaging the engaging claws, as a result of which the cap can be removed without breaking the bridges.

Additionally, as another example of conventional art, those described in Japanese Patent Application, First Publication No. Hei 7-291317 have been proposed.

The sealing device described in this publication comprises an external thread on the mouth portion of the container, an annular chin portion positioned therebelow, and ratchet claws positioned therebelow spaced along the circumferential direction. An internal thread is formed on the inner circumferential surface of the main portion of the tube portion of the synthetic resin cap, and engaging flaps which extend upward at an incline in the radial inward direction from the base end are formed on the inner circumferential surface of the tamper-evidence ring portion spaced in the circumferential direction.

When this type of sealing device formed by combining a container with a cap has the mouth and neck portions sealed by attaching the cap to the mouth portion of the container, the rotation of the cap, not the movement in the upward direction, is inhibited due to the tips in the circumferential direction of the engaging flaps formed on the tamper-evidence portion of the cap contacting the rear surfaces of the ratchet claws which rapidly extend at an incline.

That is, the conventional sealing device composed of a synthetic resin cap and a container as mentioned above has a format wherein, when the cap attached to the container mouth portion is turned in the cap-opening direction, the engaging flaps formed on the inner circumferential surface of the tamper-evidence ring portion of the cap are engaged with the ratchet claws formed on the container mouth portion to inhibit the rotation of the tamper-evidence ring portion in the cap-opening direction, as a result of which a force in the rotational direction is directly applied to a plurality of bridges which couple the main portion of the cap tube portion with the tamper-evidence ring portion to break the bridges.

However, with regard to the above-mentioned conventional sealing devices, since the bridges are severed by pulling apart the plurality of bridges at once, there is a risk that the rupture resistance of the bridges could increase so that the bridges are not sufficiently severed, or that the engaging flaps could be folded back due to the strong rupture resistance so as to pass the ratchet claws.

That is, in the weakened line of a cap tube portion formed from a horizontal score cut along the circumferential direction of the tube portion while leaving a plurality of thin bridges, each bridge has a thin pillar shape composed of synthetic resin. This type of bridge is comparatively easily stretched when a tensile force is applied in the longitudinal direction, and easily and reliably severs after a certain degree of stretching. However, when shear stress arising from the movement of the main portion which is turned in the cap-opening direction with respect to the fixed tamper-evidence ring portion is instantaneously applied to this type of bridge, the bridge has a high rupture resistance. In other words, tamper-evidence portions coupled to main portions by means of multiple bridges in this way are not easily torn even when a rotational force is applied in the cap-opening direction.

Additionally, with formats wherein bridges are severed according to conventional products as mentioned above, a large cap-opening torque is required in order to separate the tamper-evidence ring portion from the main portion, and this makes it difficult for children to open the cap. Additionally, even if one attempts to open the cap by applying a large cap-opening torque, this large force can be applied to the engaging flaps so as to cause the engaging flaps to be folded back and pass the ratchet claws, thereby making it impossible to separate the tamper-evidence ring portion.

The present invention has been achieved in consideration of the above-described situations, and has the object of offering a sealing device and container which prevents the cap-opening torque from becoming high due to the rupture resistance of the bridges when the cap attached to the container mouth portion is turned in the cap-opening direction, and which can yield good tamper-evidence capabilities by reducing the BBA when the cap is being opened.

SUMMARY OF THE INVENTION

Upon the completion of diligent research for resolving the above-mentioned problems, the present inventors focused on the fact that thin pillar-shaped bridges can be comparatively easily stretched by applying a tensile force, and simply and reliably torn, as a result of which they discovered that by stretching the bridges greatly with a small rotational angle, the rupture resistance of the bridges can be reduced and the BBA for opening the cap can be reduced, thereby achieving the present invention as a structure for practicalizing this.

That is, the sealing device of the present invention comprises a container and a synthetic resin cap attached to a mouth portion thereof; wherein said synthetic resin cap has a cap main body comprising a top plate portion and a tube portion extending downward from the periphery thereof, said tube portion being separated by means of a tearable weakening line into an upper main portion and a lower tamper-evidence ring portion, a threaded portion being formed on an inner wall surface of said main portion, and erectable engaging projections being provided on an inner wall surface of said tamper-evidence ring portion; and said container has an external thread formed on an outer circumference of an upper end of said mouth portion thereof, an annular expanded portion formed underneath said external thread, and at least one depressing portion formed on said expanded portion which engages said engaging projections on said cap and pushes down said engaging projections when said synthetic resin cap attached to said container mouth portion is twisted in a cap-opening direction.

The sealing device of the present invention may have a structure wherein said depressing portion has an inclined surface which gradually expands downward in a cap-opening direction.

The sealing device of the present invention may have a structure wherein said depressing portion is such that a side which contacts the engaging projections when the cap is opened is made into an inclined surface which gradually expands downward in a cap-opening direction, and the opposite side from said inclined surface is made into a storage guide surface having a projection height which gradually decreases in a cap-opening direction.

The sealing device of the present invention may have a structure wherein the inclination angle of said inclined surface of said depressing portion is 5~50 degrees.

The sealing device of the present invention may have a structure wherein the weakening line of said synthetic resin cap is a horizontal score formed by cutting said tube portion in a circumferential direction while leaving a plurality of thin bridges.

The sealing device of the present invention may have a structure wherein the engaging projections of said synthetic resin cap are a plurality of erectable tabs which are formed such as to project plate-wise from an inner wall of said tamper-evidence ring portion.

The sealing device of the present invention may have a structure wherein a vertical weakening line which is severed at roughly the same time that the weakening line is severed so as to break said tamper evidence ring portion into a band are formed on said tamper-evidence ring portion of said synthetic resin cap.

The sealing device of the present invention should preferably be such that the bridge breaking angle which is the rotational angle of the position at which the said bridges are severed when said cap attached to said container mouth portion is rotated in a cap-opening direction is 90 degrees or less.

Additionally, the container according to the present invention is attached with a synthetic resin cap which has a cap main body comprising a top plate portion and a tube portion extending downward from the periphery thereof, said tube portion being separated by means of a tearable weakening line into an upper main portion and a lower tamper-evidence ring portion, a threaded portion being formed on an inner wall surface of said main portion, and erectable engaging projections being provided on an inner wall surface of said tamper-evidence ring portion; said container having an external thread formed on an outer circumference of an upper end of said mouth portion thereof, an annular expanded portion formed underneath said external thread, and at least one depressing portion formed on said expanded portion which engages said engaging projections on said cap and pushes down said engaging projections when said synthetic resin cap attached to said container mouth portion is twisted in a cap-opening direction.

The container of the present invention may have a structure wherein said depressing portion has an inclined surface which gradually expands downward in a cap-opening direction.

The container of the present invention may have a structure wherein said depressing portion is such that a side which contacts the engaging projections when the cap is opened is made into an inclined surface which gradually expands downward in a cap-opening direction, and the opposite side from said inclined surface is made into a storage guide surface having a projection height which gradually decreases in a cap-opening direction.

The container of the present invention may have a structure wherein the inclination angle of said inclined surface of said depressing portion is 5~50 degrees.

The container of the present invention may have a structure wherein engaging claw portions for engaging said engaging projections and inhibiting the rotation of said tamper-evidence ring portion in the cap-opening direction are formed on the rear side of said depressing portion in a cap-opening direction.

DESCRIPTION OF THE PREFERRED EMBODIMENTS

Figure 1:
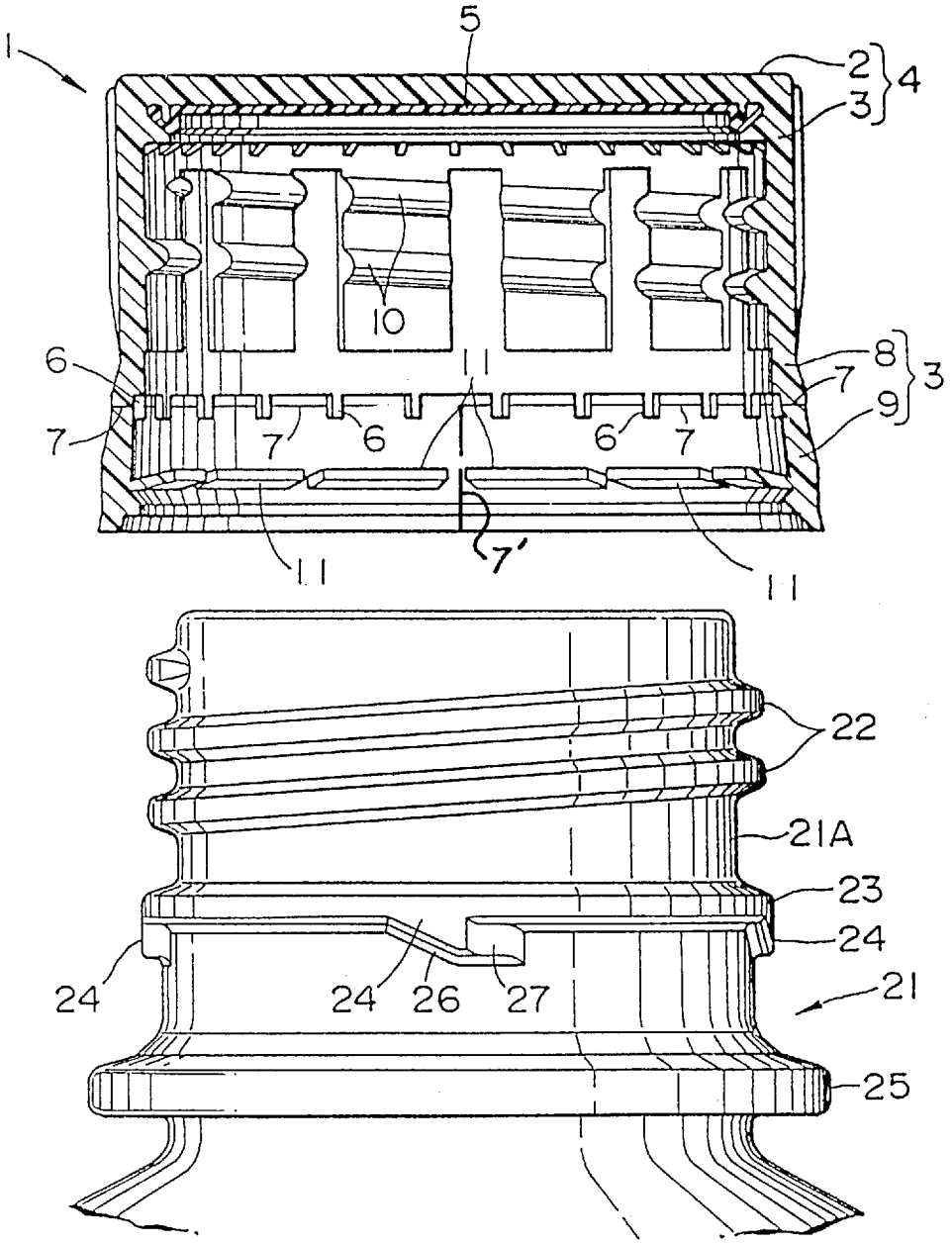
FIG. 1 is a partially cut-away front view showing an example of a sealing device according to the present invention.
Figure 2:
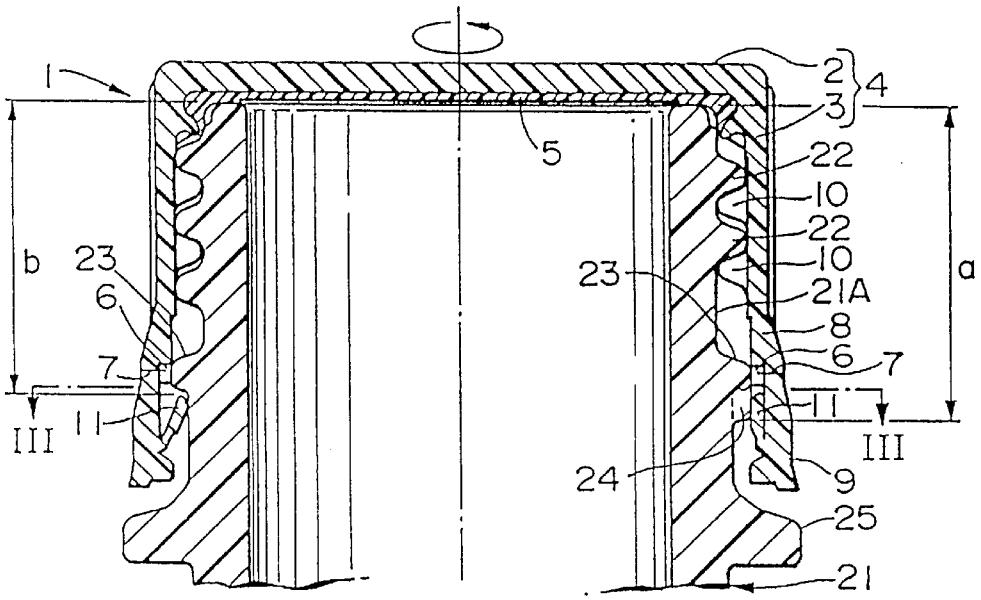
FIG. 2 is a front section view showing the same sealing device in a sealed state.

FIGS. 1 and 2 show an example of the sealing device according to the present invention. This sealing device comprises a synthetic resin cap (hereinafter referred to as a cap) 1 and a synthetic resin container 21.

The cap 1 comprises a cap main body 4 composed of a synthetic resin such as polypropylene, comprising a top plate portion 2 and a tube portion 3 extending downward from the periphery thereof, and a thin liner 5 composed of a soft resin placed inside the cap main body 4.

The tube portion 3 of the cap main body 4 is separated into an upper main portion 8 and a lower tamper-evidence ring portion 9 (hereinafter referred to as the TE ring portion) by means of a horizontal score 7 formed by cutting the tube portion 3 along the circumferential direction while leaving a plurality of thin bridges 6. A threaded portion 10 is formed on the inner wall surface of the main portion 8, and multiple-plate-shaped tabs 11 are which form engaging projections are erectably provided on the inner wall surface of the TE ring portion 9. A vertical weakening line, which breaks the TE ring portion 9 up into a band by being severed simultaneously with the severing of the horizontal score 6 is formed on the TE ring portion 9.

The above-mentioned tabs 11 are oriented roughly horizontally with their tips facing in the radial inward direction when not attached to the container, and when the cap is attached to the container mouth portion 21A, their top ends fold upward upon contact with the external thread 22 or the annular expanded portion 23, so that they can pass the external thread 22 or the annular expanded portion 23 with almost no resistance.

The dimensions of the cap 1 and the container mouth portion 21A are not especially restricted, but examples for the range of preferable dimensions in a general-purpose-size cap will be given in the following embodiment.

The length of projection of the tabs 11 from the inner wall surface of the TE ring portion 9 should be 1.5~4.0 mm, more preferable about 2.0~3.0 mm. If this projection length is less than 1.5 mm, the contact of the tabs with the outer surface of the container is reduced so as to make it difficult for the bridges to be severed when the cap is opened, while if the projection length is more than 4.0 mm, it becomes difficult to mold and difficult to cap. Additionally, the number of tabs 11 formed, circumferential lengths of the tabs 11 and the spacing between the tabs 11 is not especially restricted, but taking the case wherein 12 tabs are formed on the inner wall surface of a TE ring portion 9 having an inner diameter of approximately 29 mm as an example, the circumferential lengths of the tabs 11 should be about 4~8 mm and the spacing between the tabs should be about 0.2~0.8 mm. If the circumferential lengths of the tabs 11 are less than 4 mm, the engaging force of the tabs 11 on the container mouth portion is weakened so as to risk the occurrence of rupture defects in the bridges, and if the circumferential lengths are greater than 8 mm, the mechanical strength of the tabs 11 increases so as to make molding difficult.

Figure 9:
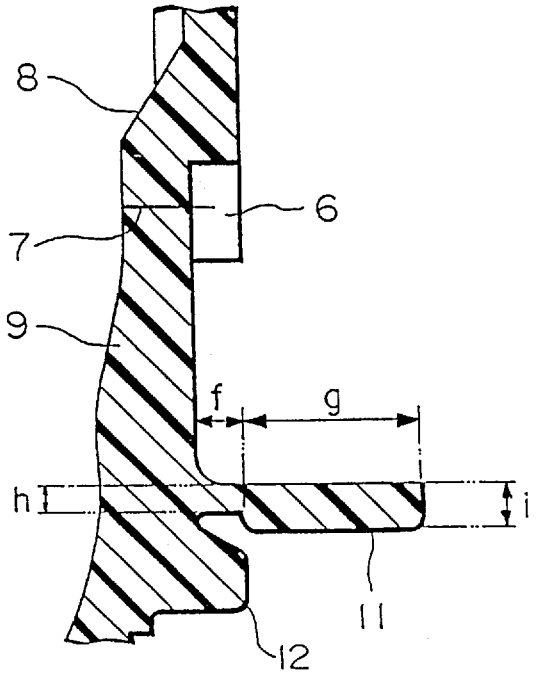
FIG. 9 is an enlarged section view of significant portions of the sealing device shown in FIG. 1.

Additionally, the thickness of the tabs 11 can be uniform, or the tip portion sides may be made thicker. Normally, the thickness of the tabs is 0.2~1.2 mm, preferably about 0.6~1.0 mm. If the tab thickness is less than 0.2 mm, the tabs can easily bend, so as to become incapable of guiding the TE ring portion 9 downward when the cap is opened, thereby risking the occurrence of rupture defects in the bridges; if the tab thickness is greater than 1.2 mm, molding becomes difficult and the capping properties are made worse. As shown in FIG. 9, when the thickness of the tabs 11 is made greater on the tip portion side than on the base portion (the inner wall side of the TE ring portion 9), for example if the base portion length f is about 0.3~0.7 mm and the tip portion length g is about 1.5~2.5 mm, the base portion thickness h should preferably be about 0.4~0.6 mm and the tip portion thickness i should preferably be about 0.5~1.0 mm. As is clear from the results of experimental examples which will be given below, when the base portion thickness f and the tip portion thickness i of the tabs 11 are less than the above-given ranges, the strength (anti-bending strength) of the tabs 11 is weakened, so that when the cap 1 is attached to the container mouth portion 21A and turned in the cap-opening direction, the tabs engaged with the depressing portions 24 have their tips bent downward, so that there may be cases wherein the cap 1 could come loose from the container mouth portion 21A without the TE ring portion 9 becoming separated from the main portion 8. Additionally, when the base portion thickness f and the tip portion thickness i of the tabs 11 are greater than the above-given ranges, the strength of the tabs 11 (anti-bending strength) is unnecessarily increased so that the resistance when the tabs 11 pass the depressing portions 24 increases during attachment of the cap 1 to the container mouth portion 21A, thereby risking a problem wherein the cap 1 cannot be sufficiently closed to the standard screw completion angle.

While the number of bridges 6 formed in not especially restricted, the overall sum of the cross-sectional areas of all of the bridges 6 should be about 0.3~9.0 $mm^2$, and the overall sum of the rupture strengths of the bridges 6 when pulled should be about 10~18 kg. When the overall sum of the cross-sectional areas of the bridges 6 is greater than 9.0 $mm^2$ and the rupture strength (when pulled) of the bridges is greater than 18 kg, the cap can come loose without the bridges being severed when the cap is opened, or the relation BBA>SRA could arise so as to make the tamper-evidence properties (cap-opening display properties) worse. When the overall sum of the cross-sectional areas of the bridges 6 is less than 0.3 $mm^2$ and the rupture strength (when pulled) of the bridges is less than 10 kg, the bridges can be severed during capping.

The container 21 has an external thread 22 formed on the outer circumference at the upper end portion of the mouth portion, with an annular expanded portion 23 provided underneath the external thread 22, and a flange portion 25 formed underneath the annular expanded portion 23.

A plurality (four in the examples shown in FIGS. 1 through 4) of depressing portions 24 for engaging the tabs 11 of the cap 1 and pressing down the tabs 11 when the cap 1 attached to this container mouth portion 21A is turned in the cap-opening direction are formed on the annular expanded portion 23 spaced in the circumferential direction of the annular expanded portion 23.

On each of these depressing portions 24, the side which contacts the tabs 11 when opening the cap is made into an inclined surface 26 which gradually expands downward toward the cap opening direction, and the opposite side from the inclined surface 26 is made into a storage guide surface 27 of which the projection height gradually decreases in the cap-opening direction.

The angle of inclination 0 of the inclined surface 26 of the depressing portions 24 should be 5~50 degrees. If this angle is greater than 50 degrees, the resistance of the tabs to being pressed down when the cap 1 attached to the container mouth portion 21A is turned in the cap-opening direction, and cases may arise wherein the tabs are not pressed down. Additionally, when the angle θ is less than 5 degrees, the BBA becomes too large.

Additionally, the difference (a–b) between the length a from the upper end of the container mouth portion 21A and the lower ends of the depressing portions 24, and the length b from the upper end of the container mouth portion 21A and the upper end of the tabs 11 of the cap 1 when attached as shown in FIG. 2 should be at least 0.5 mm. If this difference (a–b) is less than 0.5 mm, there may be cases wherein the bridges 6 are not severed due to stretching of the bridges 6.

Figure 4:
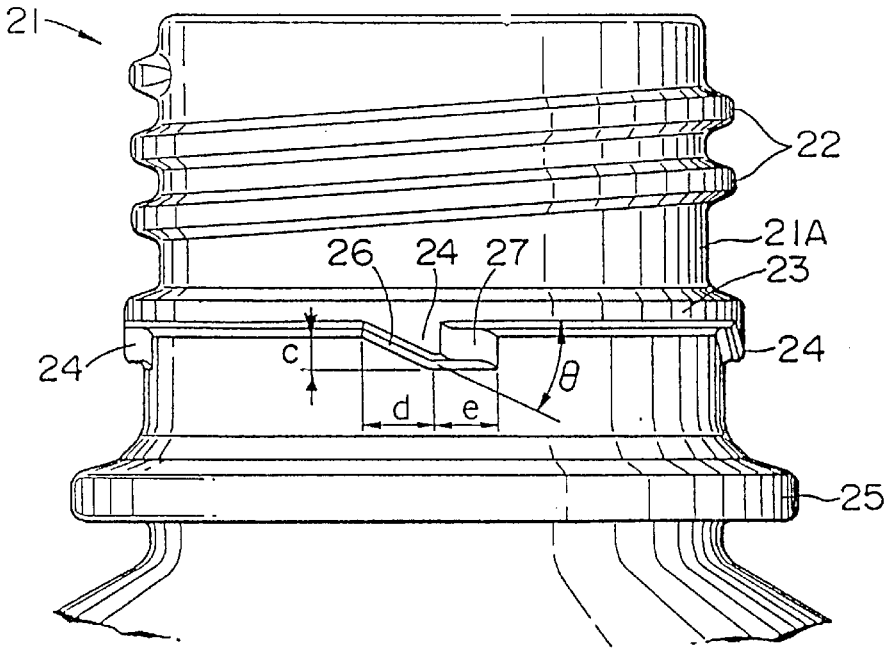
FIG. 4 is a front view of significant portions showing the container of the same sealing device.

Additionally, the length c from the annular expanded portion 23 to the bottom ends of the depressing portions 24 as shown in FIG. 4 should be 0.5~4.0 mm. If this length c is less than 0.5 mm, the tab depressing effect is not sufficiently activated during cap-opening so as to increase the BBA, and if the length c is greater than 4.0 mm, the excess thickness is increased so as to present a disadvantage in terms of cost.

Additionally, the circumferential length d of the inclined surface 26 should be 1.5~8.0 mm. If this length d is less than 1.5 mm, the tab depressing effect is not sufficiently activated during cap-opening, and if the length d is greater than 8.0 mm, the excess thickness is increased so as to present a disadvantage in terms of cost.

Additionally, the circumferential length e of the storage guide surface 27 should be 0.5~7.0 mm. If this length e is less than 0.5 mm, the BBA increases, and if greater than 7.0 mm, the excess thickness is increased so as to present a disadvantage in terms of cost.

Furthermore, the outer diameters of the external thread 22, the annular expanded portion 23 and the depressing portions 24 can be made equal. Additionally, the width of the annular expanded portion 23 should be 0.5 mm or greater, more preferably 1.0~5.0 mm.

Next, the operations of the sealing device according to the present example will be explained.

After being filled with a desired content fluid, the container 21 is conveyed to a cap attachment apparatus omitted from the drawings, and the cap 1 is screwed and fitted to seal the cap 1 onto the mouth portion 21A while supporting the bottom surface of the flange 25, preferably in a suspended state.

When the cap 1 is attached to the container mouth portion 21A, the tabs 11 of the cap 1 pass by the annular expanded portion 23 with the tips folded upward, so that no excessive forces are applied to the bridges 6.

Additionally, in the final stage of attaching the cap 1, the tabs 11 which overlap the depressing portions 24 in the attached state pass the annular expanded portion 23, and achieve contact with the storage guide surfaces 27 of the depressing portions 24 with tips slightly opened toward the radially inward side so that the tips contact the outer circumferential surface of the container mouth portion underneath the annular expanded portion 23. If the surfaces opposite to the inclined surfaces 26 of the depressing portions 24 are vertical surfaces, the tabs 11 moving in the cap-closing direction while slightly opened hit the opposite surfaces of the inclined surfaces 26 and the tabs 11 are caught so as to inhibit movement of the TE ring portion 9, thereby causing a problem in that the bridges 6 are severed; however, in the present example, tab storage guide surfaces 27 having projection heights which gradually decrease in the cap-opening direction are formed on the opposite sides of the inclined surfaces 26 of the depressing portions 24, as a result of which these tabs 11 are folded with the tips upward along the inclines of the storage guide surfaces 27 when the tabs 11 are moved in the cap-closing direction while contacting the storage guide surfaces 27, so that the bridges 6 are not severed.

Figure 3:
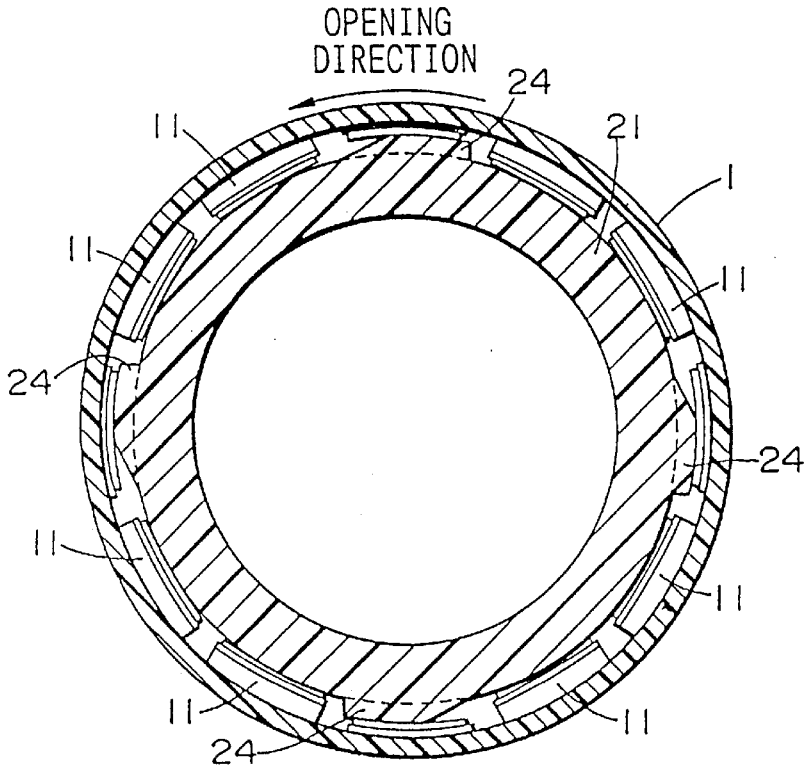
FIG. 3 is a section view of the III—III portion in FIG. 2 showing the same sealing device.

The cap 1 is attached in the state shown in FIGS. 2 and 3 by twisting the cap 1 onto the container mouth portion 21A with a predetermined cap-closing torque value. In this state wherein the cap is attached, all of the tabs 11 of the plurality of tabs 11 on the cap 1 aside from the four which overlap the depressing portions 24 are in a slightly open state in the radially inward direction so that the tips contact the outer circumferential surface of the container mouth portion underneath the annular expanded portion 23, and the four tabs 11 overlapping the depressing portions 24 have their tips folded upward.

Additionally, the upper end portion of the container 21 is pressed into contact with the liner 5 of the cap 1 so as to cause a slight indentation, thereby sealing the container 21.

Figure 5:
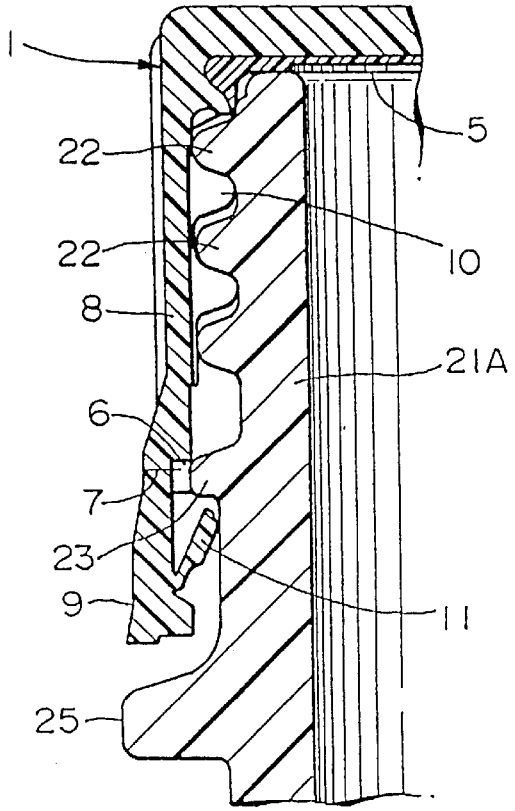
FIG. 5 is a section view of significant portions showing the same sealing device in a sealed state.
Figure 6:
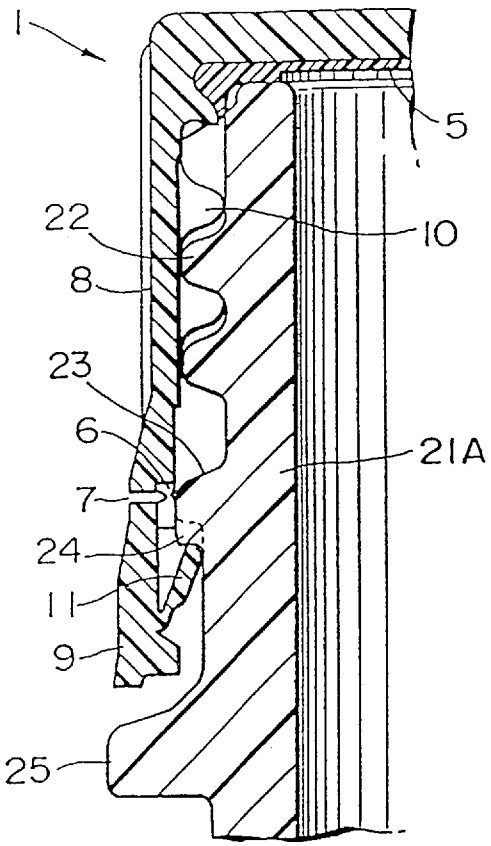
FIG. 6 is a section view of significant portions showing the same sealing device with the cap rotated in a cap-opening direction.
Figure 7:
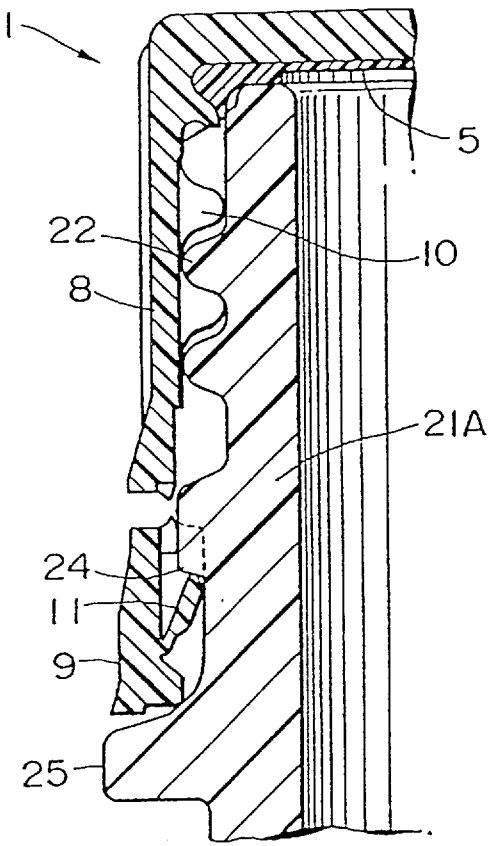
FIG. 7 is a section view of significant portions of the same sealing device directly after the bridges have been severed.

The operations for opening the cap of the sealing device when the cap is attached will be explained with reference to FIGS. 5 through 7. When the cap 1 attached to the container mouth portion 21A as shown in FIG. 5 is turned in the cap-opening direction, a slight rotational movement of the cap 1 causes the tip portions of the tabs 11 on the cap-opening direction side to contact the inclined surfaces 26 of the into depressing portions 24 of the container mouth portion 21A, so that the tip portions of the tabs 11 are pushed down along the inclines of the inclined surfaces 26 as shown in FIG. 6. Then, the TE ring portion 9 is pushed down while the main portion 8 is rotated in the cap-opening direction and lifted upward, so that the main portion 8 and the TE ring portion 9 are immediately separated. As a result, a tensile force is instantly applied to the plurality of bridges 6 which connect the main portion 8 with the TE ring portion 9 and these bridges 6 are torn apart, so that the TE ring portion 9 and the main portion 8 are separated as shown in FIG. 7. At roughly the same time that the TE ring portion 9 is separated from the main portion 8, the vertical weakening line formed on the TE ring portion 9 is severed so as to break the TE ring portion 9 into a band, thus clearly indicating that the cap 1 has been opened.

Thereafter, the main portion 8 can be removed from the container mouth portion 21A by rotating the main portion 8 further in the cap-opening direction.

With the sealing device of the present example, since the container 21 is provided with depressing portions 24 which engage and depress the tabs 11 of the cap 1 when the cap 1 attached to the mouth portion 21A is turned in the cap-opening direction, so that when the cap 1 attached to the container mouth portion 21A is turned in the cap-opening direction, the tabs 11 adjacent to respective depressing portions 24 contact the depressing portions 24 and are pushed down such that the TE ring portion 9 is pushed down, the main portion 8 which is lifted upward along the external thread 22 and the TE ring portion 9 are quickly separated and the plurality of thin bridges 6 coupling the main portion 8 with the TE ring portion 9 are stretched, so that these bridges 11 are severed by means of a minimal rotation in the cap-opening direction to separate the TE ring portion 9 from the main portion 8, thereby clearly indicating that the cap has been opened. Therefore, according to this sealing device, the bridge breaking-angle (BBA) which is the rotational angle of the position at which the bridges 6 are severed by rotating the cap 1 attached to the container mouth portion 21A in the cap-opening direction can be made 90 degrees or less, preferably 45 degrees or less; furthermore, the problem wherein the cap-opening torque is increased due to the rupture resistance of the bridges can be prevented in comparison to conventional products having the format wherein the bridges are severed by inhibiting the rotation of the TE ring portion 9, thus allowing the cap to be opened by a suitable cap-opening torque.

Additionally, due to the depressing portions 24 formed on the annular expanded portion 23, the tips of the tabs 11 which are adjacent to and approach the depressing portions 24 approach and contact the bottom surface of the annular expanded portion 23 as shown in FIG. 5 when the cap 1 in a closed state is turned in the cap-opening direction, so that the tabs 11 can be prevented from moving in the direction wherein the tips would be folded upward, while the tips of the tabs 11 can be smoothly guided to the inclined surfaces 26 of the depressing portions 24. Therefore, when the cap 1 in a closed state is turned in the cap-opening direction, the tips of the tabs 11 contact the depressing portions 24 and their tips are folded upward so that they will not pass by the depressing portions 24 without engagement, thus allowing the erectable tabs 11 to be accurately guided to the depressing portions 24 to be pushed down.

Figure 8:
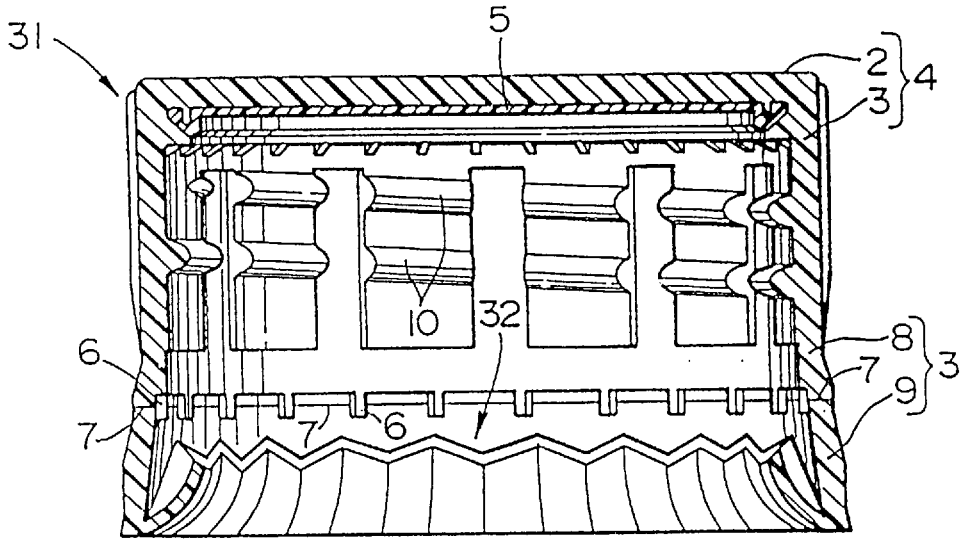
FIG. 8 is a front section view showing another example of a cap which can be applied to the sealing device according to the present invention.

FIG. 8 is a diagram showing another example of a cap which can be applied to the sealing device according to the present invention.

Similar to the cap 1 of the previous example, this cap 31 comprises a cap main body 4 composed of a synthetic resin such as polypropylene, comprising a top plate portion 2 and a tube portion 3 extending downward from the periphery thereof, and a thin liner 5 composed of a soft resin placed inside the cap main body 4. The tube portion 3 of the cap main body 4 is separated into an upper main portion and a lower TE ring portion 9 by means of a horizontal score 7 formed by cutting the tube portion 3 along the circumferential direction while leaving a plurality of thin bridges 6. A threaded portion 10 is formed on the inner wall surface of the main portion 8. Instead of the tabs 11 of the previous example, the inner wall surface of the TE ring portion 9 of this cap 31 has a strip-shaped element 32 (engaging projection) composed formed by connecting a plurality of wedge-shaped or U-shaped projections extending diagonally upward from the bottom end portion of the TE ring portion 9. When this strip-shaped element 32 is attached to the container mouth portion 21A, the projection portions of the strip-shaped element 32 expand so that the diameter of the strip-shaped element 32 is easily enlarged, so as to allow attachment by passing over the annular projection 23 and the external thread 22 of the container mouth portion 21A. When the cap 32 is attached, the compression in the radial outward direction of the strip-shaped element 32 is undone so that the tips of the projection portions of the strip-shaped element 32 approach and contact the bottom end of the annular projection 23 or the outer circumferential surface of the container mouth portion directly underneath. Then, when the cap 31 attached to the container mouth portion 21A is turned in a cap-opening direction, the tips of the strip-shaped element 32 engage with the depressing portions 24 of the container 21 and the strip-shaped element 32 is pushed down, so that the plurality of bridges 6 are instantly severed to separate the TE ring portion 9, similar to the cap 1 according to the previous example.

Therefore, as with the sealing device of the previous example, a sealing device with this cap 31 applied to the container 21 offers exceptional effects, such as to allow the BBA 90 degrees or less, preferably 45 degrees or less.

The present invention is not limited to the above-mentioned examples, and various changes or modifications are possible.

For example, when providing a plurality of depressing portions 24, the positional spacing in the circumferential direction may be uniform, or a number of depressing portions 24 may be shifted by a few degrees in the circumferential direction.

Additionally, besides attaching the cap 1 having a TE ring portion 9 as with the previous example, the container of the present invention can be applied to a synthetic resin cap of the type wherein multiple wings are formed on the inner wall surface of the TE ring portion 9.

Additionally, the annular expanded portion 23 may be replaced by a broken annular type expanded portion wherein island-type expanded portions are arranged in the circumferential direction by providing at least one notched portion in the circumferential direction of the annular expanded portion.

Embodiments

Caps 1 and containers 21 having the same structures as shown in FIG. 1 were made, and the performance of sealing devices composed of these caps 1 and containers 21 was studied.

Cap:

Caps 1 were made by making the cap main bodies constructed as shown in FIG. 1 with polypropylene as the material, and forming liners 5 composed of a polypropylene-type resin inside the cap main bodies 4 by means of an in-shell molding method. The specifics of the resulting caps 1 are as follows:

| | |
|---|---|
| Outer Diameter of Cap | 30 mm |
| Height of Cap | 24.7 mm |
| Height of TE Ring Portion | 9.6 mm |
| Circumferential Length of Tabs | 6.0 mm |

(12 formed on the inner surface of the TE ring portion)

| | |
|---|---|
| Tab Projection Length | 2.5 mm |
| Tab Thickness | 0.60 mm |
| Sum of Cross-sectional Areas of Bridges | 5.7 $mm^2$ |

Container

Containers with a capacity of 1.5 liters having a mouth portion 21A as shown in FIG. 1 were made with polyethylene terephthalate (PET) as the material. The specifics of the containers 21 are as follows:

| | |
|---|---|
| Outer Diameter of Mouth Portion (minimum outer diameter) | 24.94 mm |
| Outer Diameter of External Thread and Annular Expanded Portion | 27.56 mm |
| Angle θ of Depressing Portions | 25 degrees |
| Length of a in FIG. 2 | 15.4 mm |
| Length of b in FIG. 2 | 13.6 mm |
| Length of c in FIG. 4 | 1.8 mm |
| Length of d in FIG. 4 | 6.6 mm |
| Length of e in FIG. 4 | 3.9 mm |
| Inclination Angle of Storage Guide Surfaces | 30 degrees |

Experiment 1

The rupture strength of the bridges in the tensile direction of the caps were determined. The TE ring portion of each cap was affixed to the stand side of a push-pull gauge (stand: IMADA SEISAKUJO Model 5020; push-pull gauge: NTTONIC Type PDE-50R), the main portion was affixed to the terminal portion of the gauge, then a tensile force was applied across the main portion and the TE ring portion and the tensile strength at the time the bridges broke was measured. As a result, the produced caps had a rupture strength of the bridges in the tensile direction of 14 kg (average value, n=100).

Experiment 2

Using the above-mentioned caps and containers, (1) the bridge rupture occurrence rate when the caps were attached, (2) the cap-opening torque value for opening the caps, (3) the BBA, (4) the SRA, and (5) the bridge rupture defect occurrence rate for opening the caps were evaluated.

The above-mentioned containers were filled with a standard amount of hot water of 85° C., and the caps were attached to the mouth portions by using a capping machine (ALCOA Magnatorque). The capping conditions were set to 15 kg·cm of static torque and 15 kg of top-load.

After the containers were capped, the caps were outwardly checked for the presence of bridge ruptures, as a result of which (1) the bridge rupture occurrence rate was found to be 0% (n=100).

Next, the capped containers were opened to evaluate (2) the cap-opening torque value for opening the caps, (3) the BBA, (4) the SRA, and (5) the bridge rupture defect occurrence rate.

As a result, (2) the torque values for opening the caps were 13 kg·cm (one-dimensional) and 5–7 kg·cm (two-dimensional) (n=100). The (3) BBA was approximately 40 degrees (average value, n=100). The (4) SRA was approximately 120 degrees (average value, n=100). The (5) bridge rupture defect occurrence rate was 0 (n=100).

As is clear from the above test results, the sealing device according to the present invention was remarkable, such that the problem of increased cap-opening torque due to bridge rupture resistance was prevented when the cap attached to the container mouth portion was turned in the cap-opening direction, and the BBA when opening the cap was small.

Experiment 3

Caps were made wherein the shapes of the tabs 11 on the caps 1 described above were such that the thickness of the tip portion was greater than the base portion (near the TE ring portion 9) as shown in FIG. 9, attached to the mouth portions 21A of the above-described containers 21, and the relationships between the cap-opening display performance and capping suitability were evaluated.

The tabs 11 were made so that the total projection length (f+g) was 2.5 mm, the base portion length (f) was 0.5 mm and the tip portion length (g) was 2.0 mm, and caps of samples 1–7 and comparative products having base portion thicknesses (h) and tip portion thicknesses (i) as listed in Table 1 were made.

The above-mentioned containers 21 were filled with a standard amount of hot water of 85° C., and the caps were attached to the mouth portions 21A by using a capping machine ALCOA Magnatorque). The capping conditions were set to 15 kg·cm of static torque and 15 kg of top-load. The following categories a~d were studied for each sample, and the results are recorded in Table 1.

a. Strength of Bridges of Cap

The rupture torque values of the bridges for opening the caps was measured (units in kg·cm).

b. Strength of Tabs of Cap (Anti-bending Strength)

For each cap listed in Table 1, a sample was prepared wherein the horizontal score 7 for separating the TE ring portion 9 were not formed, each sample cap was attached to a container mouth portion 21A and opened, and the torque value at the moment the tabs 11 inverted so that the cap 1 came loose from the container mouth portion 21A was measured (units in kg·cm).

C. Evaluation of Cap-opening Display Ability

The occurrence of cap-opening display defective products wherein the tabs 11 inverted without the bridges 6 breaking when the cap was opened so that the cap 1 came free from the container mouth portion 21A with the TE ring portion 9 still connected to the main portion 8 was evaluated (n=10). The evaluations are indicated by an "O" for sample caps without cap-opening display defective products, and by an "X" for sample caps wherein cap-opening display defects occurred at least once.

d. Evaluation of Capping Suitability

The tightness of the caps when the sample caps were respectively attached to the container mouth portions 21A were evaluated as an average value of 10 trials (n=10) per sample by measuring the relative rotational angles between the beginnings of the threads on the containers (upper side of the mouth portions) and the beginnings of the threads on the caps (bottom side of the caps). The evaluations are indicated by an "O" for sample caps wherein the relative rotational angle (average value) was 580°±30°, and by an "X" for sample caps which lay outside the above-mentioned angles.

TABLE 1

| SAMPLE | TAB THICKNESS Base Portion | TAB THICKNESS Tip Portion | STRENGTH OF BRIDGES (kg · cm) | STRENGTH OF TABS (kg · cm) | CAP-OPENING DISPLAY ABILITY | CAPPING SUIT-ABILITY |
|---|---|---|---|---|---|---|
| Comp. Ex. | 0.3 mm | 0.3 mm | 13.2 | 10.8 | X | o |
| 1 | 0.3 mm | 0.4 mm | 13.2 | 13.4 | X | o |
| 2 | 0.4 mm | 0.5 mm | 13.2 | 20.9 | o | o |
| 3 | 0.5 mm | 0.7 mm | 13.2 | 22.6 | o | o |
| 4 | 0.5 mm | 0.9 mm | 13.2 | 23.6 | o | o |
| 5 | 0.6 mm | 1.0 mm | 13.2 | 27.4 | o | o |
| 6 | 0.7 mm | 1.2 mm | 13.2 | 30.3 | o | X |
| 7 | 0.8 mm | 1.4 mm | 13.2 | 32.4 | o | X |

The results in Table 1 indicate that when the thickness of the tabs 11 is made greater on the tip portion side than on the base portion, the base portion thickness h should preferably be 0.4~0.6 mm and the tip portion thickness i should preferably be 0.5~1.0 mm.

INDUSTRIAL APPLICABILITY

As explained above, with the sealing device according to the present invention, the bridge breaking angle (BBA) which is the rotational angle of the position at which the bridges break, can be made 90 degrees or less, preferably 45 degrees or less; furthermore, problems wherein the cap-opening torque increases due to the rupture resistance of the bridges can be prevented in comparison to conventional products of the type wherein the bridges are severed by inhibiting the rotation of the TE ring portions, so as to allow the cap to be opened with an appropriate cap-opening torque.

Additionally, due to the depressing portions formed on the annular expanded portion, the tips of the tabs which are adjacent to and approach the depressing portions approach and contact the bottom surface of the annular expanded portion when the cap in a closed state is turned in the cap-opening direction, so that the tabs can be prevented from moving in the direction wherein the tips would be folded upward, while the tips of the tabs can be smoothly guided to the inclined surfaces of the depressing portions. Therefore, when the cap in a closed state is turned in the cap-opening direction, the tips of the tabs contact the depressing portions and their tips are folded upward so that they will not pass by the depressing portions without engagement, thus allowing the erectable tabs to be accurately guided to the depressing portions to be pushed down.

I claim:

1. A sealing device comprising the combination of a container and a synthetic resin cap attached to a mouth portion thereof; wherein said synthetic resin cap has a cap main body comprising a top plate portion and a tube portion extending downward from a periphery thereof, said tube portion being separated by a tearable weakening line into an upper main portion and a lower tamper-evidence ring portion, a threaded portion being formed on an inner wall surface of said main portion, and erectable engaging projections being provided on an inner wall surface of said tamper-evidence ring portion;

said container has an external thread formed on an outer circumference of an upper end of said mouth portion thereof, an annular expanded portion formed underneath said external thread, and at least one depressing portion formed on said expanded portion which engages said engaging projections on said cap and pushes down said engaging projections when said synthetic resin cap attached to said container mouth portion is twisted in a cap-opening direction;

said depressing portion has an inclined surface which gradually expands downward in a cap-opening direction and a storage guide surface: and said expanded portion has a horizontal step portion which continues to said inclined surface at one end and to said storage guide surface at another end.

2. A sealing device in accordance with claim 1, wherein an inclination angle of said inclined surface of said depressing portion is 5~50 degrees.

3. A sealing device in accordance with claim 1, wherein the engaging projections of said synthetic resin cap are a plurality of erectable tabs which are formed such as to project plate-wise from an inner wall of said tamper-evidence ring portion.

4. A sealing device in accordance with claim 1, wherein a vertical weakening line which is severed at roughly the same time that the weakening line is severed so as to break said tamper evidence ring portion into a band is formed on said tamper-evidence ring portion of said synthetic resin cap.

5. A sealing device in accordance with claim 1, wherein said depressing portion is such that a side which contacts the engaging projections when the cap is opened is made into said inclined surface and the opposite side from said inclined surface is made into said storage guide surface having a projection height which gradually decreases in a cap-opening direction.

6. A sealing device in accordance with claim 5, wherein the inclination angle of said inclined surface of said depressing portion is 5~50 degrees.

7. A sealing device in accordance with claim 1, wherein the weakening line of said synthetic resin cap is a horizontal score formed by cutting said tube portion in a circumferential direction while leaving a plurality of thin bridges.

8. A sealing device in accordance with claim 7, wherein a bridge breaking angle which is the rotational angle of the position at which said bridges are severed when said cap attached to said container mouth portion is rotated in a cap-opening direction is 90 degrees or less.

9. The combination of a container which is attached with a synthetic resin cap which has a cap main body comprising a top plate portion and a tube portion extending downward from a periphery thereof, said tube portion being separated by a tearable weakening line into an upper main portion and a lower tamper-evidence ring portion, a threaded portion being formed on an inner wall surface of said main portion, and erectable engaging projections being provided on an inner wall surface of said tamper-evidence ring portion;

said container having an external thread formed on an outer circumference of an upper end of said mouth portion thereof, an annular expanded portion formed underneath said external thread, and at least one depressing portion formed on said expanded portion which engages said engaging projections on said cap and pushes down said engaging projections when said synthetic resin cap attached to said container mouth portion is twisted in a cap-opening direction; wherein said depressing portion has an inclined surface which gradually expands downward in a cap-opening direction and a storage guide surface; and said expanded portion has a horizontal step portion which continues to said inclined surface at one end and to said storage guide surface at another end.

10. A container in accordance with claim 9 wherein engaging claw portions for engaging said engaging projections and inhibiting the rotation of said tamper-evidence ring portion in the cap-opening direction are formed on the rear side of said depressing portion in a cap-opening direction.

11. A container in accordance with claim 9, wherein an inclination angle of said inclined surface of said depressing portion is 5~50 degrees.

12. A container in accordance with claim 11, wherein engaging claw portions for engaging said engaging projections and inhibiting the rotation of said tamper-evidence ring portion in the cap-opening direction are formed on the rear side of said depressing portion in a cap-opening direction.

13. A container in accordance with claim 9, wherein when said cap is attached to said container, (i) engaging projections other than said engaging projections engaged with said at least one depressing portion are in a slightly open state in a radially inward direction such that tips thereof contact the outer circumferential surface of the container mouth portion underneath said annular expanded portion, and (ii) said engaging projections engaged with said at least one depressing portion have tips thereof folded upwardly.

14. A container in accordance with claim 13, wherein four said engaging projections are engaged by respective depressing portions formed on said expanded portion of said container.

15. A container in accordance with claim 9, wherein said depressing portion is such that a side which contacts the engaging projections when the cap is opened is made into said inclined surface, and the opposite side from said inclined surface is made into said storage guide surface having a projection height which gradually decreases in a cap-opening direction.

16. A container in accordance with claim 15, wherein engaging claw portions for engaging said engaging projections and inhibiting the rotation of said tamper-evidence ring portion in the cap-opening direction are formed on the rear side of said depressing portion in a cap-opening direction.

17. A container in accordance with claim 15, wherein the inclination angle of said inclined surface of said depressing portion is 5~50 degrees.

18. A container in accordance with claim 17, wherein engaging claw portions for engaging said engaging projections and inhibiting the rotation of said tamper-evidence ring portion in the cap-opening direction are formed on the rear side of said depressing portion in a cap-opening direction.

19. A sealing device in accordance with claim 1, wherein, when said cap is attached to said container, (i) engaging projections other than said engaging projections engaged with said at least one depressing portion are in a slightly open state in a radially inward direction such that tips thereof contact the outer circumferential surface of the container mouth portion underneath said annular expanded portion, and (ii) said engaging projections engaged with said at least one depressing portion have tips thereof folded upwardly.

20. A sealing device in accordance with claim 19, wherein four said engaging projections are engaged by respective depressing portions formed on said expanded portion of said container.

* * * * *